US008153052B2

(12) United States Patent
Jackson et al.

(10) Patent No.: US 8,153,052 B2
(45) Date of Patent: Apr. 10, 2012

(54) HIGH-TEMPERATURE COMPOSITE ARTICLES AND ASSOCIATED METHODS OF MANUFACTURE

(75) Inventors: Melvin Robert Jackson, Niskayuna, NY (US); Bernard Patrick Bewlay, Schenectady, NY (US); Judson Sloan Marte, Wynantskill, NY (US); Pazhayannur Ramanathan Subramanian, Niskayuna, NY (US); Ji-Cheng Zhao, Latham, NY (US); Ann Melinda Ritter, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 2420 days.

(21) Appl. No.: 10/671,851

(22) Filed: Sep. 26, 2003

(65) Prior Publication Data

US 2005/0069449 A1 Mar. 31, 2005

(51) Int. Cl.
*B22F 1/02* (2006.01)

(52) U.S. Cl. ..... 419/38

(58) Field of Classification Search ..... 419/38
See application file for complete search history.

(56) References Cited

U.S. PATENT DOCUMENTS

| | | | | |
|---|---|---|---|---|
| 4,836,849 | A * | 6/1989 | Svedberg et al. | 75/245 |
| 5,073,215 | A * | 12/1991 | Skinner et al. | 148/415 |
| 5,741,376 | A * | 4/1998 | Subramanian et al. | 148/422 |
| 6,428,910 | B1 * | 8/2002 | Jackson et al. | 428/660 |
| 6,692,586 | B2 * | 2/2004 | Xu et al. | 148/421 |

OTHER PUBLICATIONS

U.S. Appl. No. 10/331,104, Jackson et al.

* cited by examiner

*Primary Examiner* — Jessee R. Roe
(74) *Attorney, Agent, or Firm* — Francis T. Coppa

(57) ABSTRACT

The present invention provides a method for forming a refractory metal-intermetallic composite. The method includes providing a first powder comprising a refractory metal suitable for forming a metal phase; providing a second powder comprising a silicide precursor suitable for forming an intermetallic phase; blending the first powder and the second powder to form a powder blend; consolidating and mechanically deforming the powder blend at a first temperature; and reacting the powder blend at a second temperature to form the metal phase and the intermetallic phase of the refractory metal-intermetallic composite, wherein the second temperature is higher than the first temperature.

36 Claims, 1 Drawing Sheet

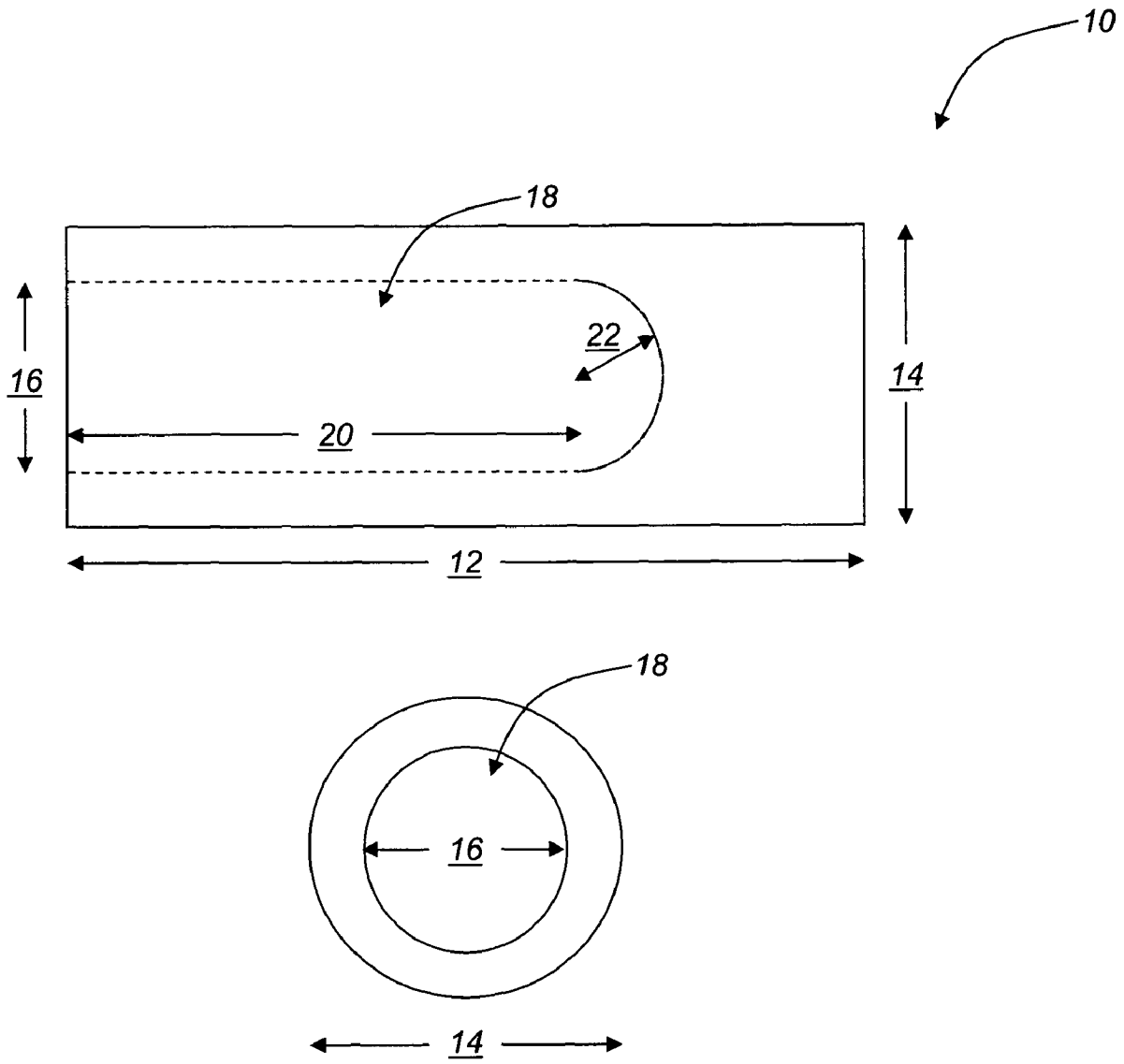
10
14
18
22
20
12
16
18
16
14

HIGH-TEMPERATURE COMPOSITE ARTICLES AND ASSOCIATED METHODS OF MANUFACTURE

FIELD OF THE INVENTION

The present invention relates generally to high-temperature composite articles and associated methods of manufacture. More specifically, the present invention relates to high-temperature components for use in turbine applications and the like and associated methods of manufacture (processing and/or forming).

BACKGROUND OF THE INVENTION

High temperature components for use in turbine applications and the like, such as aircraft engine applications, watercraft engine applications (both marine and fresh water), and land-based power generation applications, are typically manufactured from nickel (Ni)-based superalloys, iron (Fe)-based superalloys, and/or cobalt (Co)-based superalloys. Although these superalloys demonstrate a useful combination of mechanical properties at moderate temperatures, they do not demonstrate a useful combination of mechanical properties at the ever-increasing operating temperatures required to improve overall turbine performance and efficiency.

In order to overcome the temperature limitations associated with the Ni-based superalloys, the Fe-based superalloys, and the Co-based superalloys, niobium (Nb)-based refractory metal-intermetallic composites (Nb-based RMICs), such as Nb-silicide (Nb—Si) alloys and the like, have been developed. These Nb—Si alloys incorporate a relatively ductile metal phase and a relatively brittle intermetallic phase, providing a useful combination of mechanical properties over a wide range of temperatures, including low-temperature toughness and high-temperature strength and creep resistance.

The Nb—Si alloys, however, present several important manufacturing challenges. The Nb—Si alloys are typically manufactured using conventional ingot metallurgy/thermo-mechanical forming techniques, casting techniques, directional solidification techniques, and/or vapor deposition techniques. The ingot metallurgy/thermo-mechanical forming techniques, for example, suffer from the problem that the Nb—Si alloys must be extruded at temperatures of between about 1,450 degrees C. and about 1,650 degrees C., with only nominal incremental cross-sectional reductions being possible. Likewise, the casting techniques suffer from the problem that the complex chemistries and high reactivities of the Nb—Si alloys make suitable microstructural control difficult to achieve and often result in unwanted flaws. In general, the conventional techniques for manufacturing Nb—Si alloys suffer from compositional inhomogeneities, microstructural inhomogeneities, insufficient size and scale problems, and the inability to form near-net shapes.

Thus, what is needed is an improved method for manufacturing (processing and/or forming) Nb-based RMICs whereby suitable compositional and microstructural control is achieved and complex component geometries of sufficient size and scale may be formed at relatively low temperatures without the need for time-consuming, expensive post-process machining.

BRIEF SUMMARY OF THE INVENTION

In various embodiments, the present invention provides methods for manufacturing (processing and/or forming) Nb-based RMICs and the like. In general, the methods of the present invention use powder metallurgy (PM) techniques. The methods include powder blending, low-temperature/high-pressure near net-shape consolidation and mechanical deformation of the resulting powder blend, and high-temperature reaction to generate a composite article, such as a turbine airfoil or the like, with a controlled composition and microstructure. Elemental powders or pre-alloyed powders may be used, including pre-alloyed powders of both the metal phase and the intermetallic phase. These PM techniques allow the scale of the composite article to be controlled through the selection of the size of the starting powders and the design of the reduction during consolidation and mechanical deformation at relatively low temperatures.

In one embodiment of the present invention, a method for forming a refractory metal-intermetallic composite includes providing a first powder comprising a refractory metal suitable for forming a metal phase; providing a second powder comprising a silicide precursor suitable for forming an intermetallic phase; blending the first powder and the second powder to form a powder blend; consolidating and mechanically deforming the powder blend at a first temperature; and reacting the powder blend at a second temperature to form the metal phase and the intermetallic phase of the refractory metal-intermetallic composite, wherein the second temperature is higher than the first temperature.

In another embodiment of the present invention, a refractory metal-intermetallic composite is manufactured by the method described above.

In a further embodiment of the present invention, a method for forming a refractory metal-intermetallic composite article includes providing a first powder comprising a refractory metal suitable for forming a metal phase; providing a second powder comprising a silicide precursor suitable for forming an intermetallic phase; blending the first powder and the second powder to form a powder blend; consolidating and mechanically deforming the powder blend at a first temperature; and reacting the powder blend at a second temperature to form the metal phase and the intermetallic phase of the refractory metal-intermetallic composite article, wherein the second temperature is higher than the first temperature.

In a still further embodiment of the present invention, a refractory metal-intermetallic composite article is manufactured by the method described above.

BRIEF DESCRIPTION OF THE DRAWINGS

FIG. 1 is a cross-sectional side view of one embodiment of a portion of a stainless steel can used to consolidate and extrude the Nb-based RMIC powder blend of the present invention (optionally, the can may also be fabricated from molybdenum, tungsten, and/or the like).

DETAILED DESCRIPTION OF THE INVENTION

As described above, the present invention provides a method for manufacturing (processing and/or forming) Nb-based RMICs and the like. In general, the method of the present invention uses PM techniques. The method includes a plurality of steps: 1) powder blending; 2) low-temperature/high-pressure near net-shape consolidation and mechanical deformation of the resulting powder blend; and 3) high-temperature reaction to generate a composite article, such as a turbine airfoil or the like, with a controlled composition and microstructure. Elemental powders or pre-alloyed powders may be used, including pre-alloyed powders of both the metal phase and the intermetallic phase. These PM techniques allow the scale of the microstructure of the composite article to be controlled through the selection of the size of the powders and the design of the reduction during consolidation and mechanical deformation at relatively low temperatures.

The first step, powder blending, includes partitioning the final composite chemistry into a relatively ductile metal phase powder containing a refractory metal or the like, such as Nb, titanium (Ti), molybdenum (Mo), and/or the like, and a relatively brittle intermetallic phase powder containing a silicide precursor or the like, such as Si, germanium (Ge), boron (B), and/or the like. For example, the relatively ductile metal phase powder may be Nb—Ti-hafnium (Hf) powder and the relatively brittle intermetallic phase powder may be Si-chromium (Cr)-aluminum (Al) powder. It should be noted that the powders may include any suitable powders that result in the desired final composite chemistry after low-temperature/high-pressure near net-shape consolidation and mechanical deformation and high-temperature reaction. Because powders are used, the article manufactured from these powders may have property gradients, such that any part of the article that is subjected to higher temperatures and/or stresses may be formed from a material that is designed to withstand these temperatures and/or stresses, while other parts of the article may be formed from materials that have properties more suited to their utilities. For example, the powder fractions may be varied gradually, such that an airfoil structure made from the consolidated and worked material has a more ductile (lower fraction of silicide) region at the attachment root below the airfoil, and a stronger (higher fraction of silicide) region at the airfoil. Alternatively, it may be desirable to vary the properties of the materials in accordance with mathematical step functions, whereby adjacent parts of the article have large differences in properties, depending upon their desired functions.

In general, Nb-based RMICs that may be used to form articles generally comprise Ti, Hf, Si, Cr, and Nb. The Nb-based RMICs preferably comprise between about 15 atomic percent and about 30 atomic percent Ti, between about 1 atomic percent and about 8 atomic percent Hf, between about 5 atomic percent and about 25 atomic percent Si, between about 1 atomic percent and about 14 atomic percent Cr, and a balance of Nb, based upon the total composition. More preferably, the Nb-based RMICs comprise between about 15 atomic percent and about 30 atomic percent Ti, between about 1 atomic percent and about 8 atomic percent Hf, up to about 10 atomic percent tantalum (Ta), between about 5 atomic percent and about 25 atomic percent Si, up to about 6 atomic percent Ge, up to about 12 atomic percent B, between about 1 atomic percent and about 14 atomic percent Cr, up to about 4 atomic percent Fe, up to about 4 atomic percent Al, up to about 5 atomic percent tin (Sn), up to about 3 atomic percent tungsten (W), up to about 3 atomic percent Mo, and a balance of Nb, based upon the total composition. Most preferably, Si, Ge, and B together comprise between about 5 atomic percent and about 25 atomic percent of the Nb-based RMIC, Fe and Cr together comprise between about 1 atomic percent and about 18 atomic percent of the Nb-based RMIC, and the ratio of the sum of the atomic percentages of Nb and Ta present in the Nb-based RMIC and the sum of the atomic percentages of Ti and Hf present in the Nb-based RMIC is between about 1.4 and 2.2, i.e., $1.4<(Nb+Ta):(Ti+Hf)<2.2$.

Preferably, the particle size for the powders that are subjected to consolidation and mechanical deformation are between about 2 micrometers and about 75 micrometers, although other suitable particle sizes may be used. Within this range, a particle size of between about 5 micrometers and about 45 micrometers is preferred, with a particle size of between about 10 micrometers and about 38 micrometers being more preferred. The particle size is selected so as to minimize any phase segregation, as well as to generate a tough composite having a higher volume percent of silicide. For example, in Nb-based RMICs, a particle size of between about 25 micrometers and about 45 micrometers for the intermetallic phase powder and between about 5 micrometers and about 15 micrometers for the metal phase powder can be used to provide a composite having between about 30 and about 70 volume percent silicide with the metal phase being distributed in the form of a network surrounding the intermetallic phase, with the volume fraction of silicide depending upon the powder fractions of the blend.

The second step, low-temperature/high-pressure near net-shape consolidation and mechanical deformation, includes consolidating and mechanically deforming the resulting powder blend at a temperature of less than about 1,050 degrees C., although other suitable temperatures may be used. This consolidation is performed to effect consolidation of the powders to about 100% theoretical density and to introduce a degree of work into the metal phase. The consolidation is performed at combinations of time and temperature that minimize a silicide reaction in order to avoid cracking due to excessive formation of silicide during consolidation and mechanical deformation. The total time at which the powder blend is maintained at these temperatures while performing consolidation and deformation is preferably less than about 2 hours.

In general, because consolidation and mechanical deformation are performed at a relatively low temperature, lower-cost processing with lower-cost cans is possible. This processing may include, for example, cold isostatic pressing, hot isostatic pressing, hot pressing, explosive consolidation, magnetic pulse consolidation, ram pre-extrusion consolidation, hot forging, hot swaging, cold extrusion, hot extrusion, other cold and hot forging techniques, other cold and hot swaging techniques, and cold and hot rolling techniques, well known to those of ordinary skill in the art. High-energy ball milling may also be used as preliminary operation in order to achieve a coating of the metal phase powder on the surface of the intermetallic phase powder. With respect to conventional casting techniques, the scale of the phases increase with increasing ingot size and a larger size intermetallic phase leads to a degradation in the damage tolerance and fatigue characteristics of the composite. With respect to the PM techniques of the present invention, the size of the intermetallic phase is independent of the scale of the billet/starting workpiece.

The third step, high-temperature reaction, includes thermally treating the consolidated and mechanically deformed powder blend at a temperature sufficient to achieve the desired metal/intermetallic phase mixture, such as about 1,400 degrees C., although other suitable temperatures may be used. The resulting reaction produces a composite with the desired metal/intermetallic phase mixture and an optimum chemistry, as well as the correct scale for a suitable balance of mechanical and environmental properties. The time of exposure at a reaction temperature of greater than about 1,050 degrees C. should exceed 4 hours.

By concentrating the intermetallic phase-formers into an isolated powder chemistry, a larger volume fraction of the relatively ductile metal exists throughout the mechanical deformation process. For example, an Nb—Si alloy of about 50% $Nb_5Si_3$, 50% Nb may be obtained by thermally treating a worked alloy of about 82% Nb, 18% Si. The PM techniques of the present invention allow the scale of the composite article to be controlled by selecting the size of the starting powders and designing the reduction during consolidation and mechanical deformation. Conventional casting techniques use the solidification conditions to control the scale of the resulting composite article, providing less flexibility than the PM techniques. The PM techniques allow for the elimination of solidification segregation, a significant issue related to high Ti-containing alloys due to the partitioning coefficient of Ti from solid to liquid. The PM techniques of the present invention also provide the ability to manufacture relatively tough composites with higher volume fractions of silicides (for example, up to about 70% silicide) with the Nb distributed as a network in a Ni-based superalloy or the like. The PM techniques further allow for the pre-selection of phase chemistry required for a given operating temperature range. In solidification processes, this phase chemistry is influenced by the solidification path.

In general, for ease of mechanical deformation, maximum ductile metal phase content is desired, thus minimum reaction of the silicide precursor powder with the metal powder is desired. For service applications, however, maximum silicide formation is desired, thus complete reaction of the silicide precursor powder with the metal powder, where enough excess metal powder is present to retain about 30 volume percent to about 70 volume percent of the metal after the complete reaction of the precursor. Reaction is governed by the time and temperature of the thermal treatment, as well as by the minimum dimensions of the component powders after consolidation and mechanical deformation. As defined herein, the temperature required for silicide formation to begin is the temperature where, in cumulative exposures to multiple re-heats of, for example, about 2 hours total, no more than about 10 percent of the composite volume consists of reacted silicide phase. This dictates low temperatures and short times for consolidation and mechanical deformation. As defined herein, the temperature required for silicide formation to complete is the temperature where, in cumulative exposures to multiple re-heats of, for example, about 4 hours total, no more than about 5 percent of the composite by volume consists of un-reacted silicide precursor powder. This dictates high temperatures and long times for the reaction process.

The light-weight articles derived from the processes described above may be subsequently coated with an environmentally-resistant coating in order to provide the Nb-based RMIC substrates that form the articles with improved oxidation resistance. In general, the environmentally-resistant coating is crystalline and has a crystalline content of greater than about 60 weight percent, preferably greater than about 80 weight percent, and more preferably greater than about 95 weight percent, based upon the total weight of the composition. The thickness of the environmentally-resistant coating is between about 10 micrometers and about 200 micrometers. Within this range, a thickness of greater than or equal to about 15 micrometers is preferred, a thickness of greater than or equal to about 20 micrometers is more preferred, and a thickness of greater than or equal to about 25 micrometers is most preferred. Within this range, a thickness of less than or equal to about 175 micrometers is preferred, a thickness of less than or equal to about 150 micrometers is more preferred, and a thickness of less than or equal to about 125 micrometers is most preferred. As defined herein, the environmentally-resistant coating is one that provides improved oxidation resistance at temperatures of between about 1,090 degrees C. and about 1,370 degrees C. and/or improved pesting resistance at temperatures of between about 760 degrees C. and about 980 degrees C.

In addition to the environmentally-resistant coating, a thermal barrier coating may be applied to the Nb-based RMIC substrate. The thermal barrier coating may be deposited on the Nb-based RMIC substrate using an electron beam-physical vapor deposition (EB-PVD) process or a thermal spray process, such as air plasma spraying, to a thickness of between about 50 micrometers and about 400 micrometers. The thermal barrier coating includes, but is not limited to, materials such as zirconia, zirconia stabilized by the addition of other metals (such as yttrium, magnesium, cerium, and the like), zircon, mullite, and combinations comprising at least one of the foregoing materials, as well as other refractory materials having similar properties.

The following example is intended to be illustrative of the high-temperature composite articles and associated methods of manufacture of the present invention and is not intended to be limiting.

EXAMPLE

A mixture of about 75 volume percent Nb—Ti—Hf and about 25 volume percent Si—Cr—Al was consolidated in a stainless steel can 10 (FIG. 1) and hot extruded at about 950 degrees C. to produce a rectangular cross-section billet with a nominal reduction of about 6:1 (optionally, the can may also be fabricated from molybdenum, tungsten, and/or the like). The following powders were used: Nb—Ti—Hf powder—64 atomic percent Nb (about 70.95 weight percent), 30.67 atomic percent Ti (about 17.53 weight percent), 2.66 atomic percent Hf (about 5.67 weight percent), and 2.67 atomic percent W (about 5.85 weight percent); Si—Cr—Al powder—72 atomic percent Si (about 61.69 weight percent), 20 atomic percent Cr (about 31.72 weight percent), and 8 atomic percent Al (about 6.59 weight percent). The resulting powder mixture contained about 11.53 weight percent (about 25 volume percent) Si—Cr—Al and about 88.47 weight percent (about 75 volume percent) Nb—Ti—Hf (the mixture having a nominal average chemistry of 48Nb-23Ti-2Hf-2W-18Si-5Cr-2Al by atomic percent, 62.76Nb-15.51Ti-5.02Hf-5.18W-7.11Si-3.66Cr-0.76Al by weight percent). The stainless steel can 10 had a length 12 (FIG. 1) of about 7 inches, an outside diameter 14 (FIG. 1) of about 2.75 inches, and an inside diameter 16 (FIG. 1) of about 2 inches. The internal cavity 18 (FIG. 1) had a cylindrical depth 20 (FIG. 1) of about 4.5 inches and a radial depth 22 (FIG. 1) of about 2 inches. The stainless steel can 10 was filled with about 1,135 grams of the powder mixture (about 1,004.1 grams Nb—Ti—Hf and about 130.9 grams Si—Cr—Al). The stainless steel can 10 was then evacuated and sealed by welding, and extrusion at about a 6:1 ratio was performed at about 950 degrees C. (optionally, at about 1,000 degrees C.). The extruded billet was hot transverse-rolled to a total of about 40% reduction in a series of successive heatings to about 950 degrees C. and about 10% reductions. Subsequent hot longitudinal-rolling resulted in some cracking due to excessive intermetallic phase formation between the metal phase powder and the intermetallic phase powder after the several heatings. Due to the inherent ductility of Nb, even greater deformation is possible if processing were to be performed at lower temperatures to avoid the possibility of excessive intermetallic phase formation. Thermal treatment was carried out at about 1,200 degrees C. in a vacuum or argon (Ar) for about 4 hours (optionally, at about 1,400 degrees C. in a vacuum or Ar for about 4 hours at about 5 ksi isostatic pressure).

Although the present invention has been illustrated and described with reference to preferred embodiments and examples thereof, it will be readily apparent to those of ordinary skill in the art that other embodiments and examples may perform similar functions and/or achieve similar results. All such equivalent embodiments and examples are within the spirit and scope of the present invention and are intended to be covered by the following claims.

What is claimed is:

1. A method for forming a refractory metal-intermetallic composite, the method comprising:

providing a first powder comprising a refractory metal suitable for forming a metal phase;

providing a second powder comprising a silicide precursor suitable for forming an intermetallic phase;

blending the first powder and the second powder to form a powder blend;

consolidating and mechanically deforming the powder blend at a first temperature;

reacting the powder blend at a second temperature to form the metal phase and the intermetallic phase of the refractory metal-intermetallic composite, wherein the second temperature is higher than the first temperature;

wherein the first powder comprises at least one of niobium, titanium, and molybdenum; and the second powder comprises at least one of silicon, germanium, and boron wherein the refractory metal-intermetallic composite has a graded composition.

2. The method of claim 1, wherein the first powder comprises niobium, titanium, and hafnium.

3. The method of claim 1, wherein the second powder comprises silicon, chromium, and aluminum.

4. The method of claim 1, wherein the refractory metal-intermetallic composite comprises titanium, hafnium, silicon, chromium, and niobium.

5. The method of claim 1, wherein the refractory metal-intermetallic composite comprises between about 15 atomic percent and about 30 atomic percent titanium, between about 1 atomic percent and about 8 atomic percent hafnium, between about 5 atomic percent and about 25 atomic percent silicon, between about 1 atomic percent and about 14 atomic percent chromium, and a balance of niobium, based upon the . total composition.

6. The method of claim 1, wherein the refractory metal-intermetallic composite comprises between about 15 atomic percent and about 30 atomic percent titanium, between about 1 atomic percent and about 8 atomic percent hafnium, up to about 10 atomic percent tantalum, between about 5 atomic percent and about 25 atomic percent silicon, up to about 6 atomic percent germanium, up to about 12 atomic percent boron, between about 1 atomic percent and about 14 atomic percent chromium, up to about 4 atomic percent iron, up to about 4 atomic percent aluminum, up to about 5 atomic percent tin, up to about 3 atomic percent tungsten, up to about 3 atomic percent molybdenum, and a balance of Niobium, based upon the total composition.

7. The method of claim 1, wherein the refractory metal-intermetallic composite comprises silicon, germanium, and boron, together comprising between about 5 atomic percent and about 25 atomic percent of the refractory metal-intermetallic composite, iron and chromium, together comprising between about 1 atomic percent and about 18 atomic percent of the refractory metal-intermietallic composite.

8. The method of claim 1, wherein consolidating the powder blend comprises consolidating the powder blend using a technique selected from the group consisting of cold isostatic pressing, hot isostatic pressing, hot pressing, explosive consolidation, magnetic pulse consolidation, ram pre-extrusion consolidation, hot forging, hot swaging, and hot extrusion.

9. The method of claim 1, wherein mechanically deforming the powder blend comprises mechanically deforming the powder blend using a technique selected from the group consisting of cold extrusion, hot extrusion, cold forging, hot forging, cold rolling, hot rolling, cold swaging, and hot swaging.

10. The method of claim 1, wherein the first temperature is less than that required for a silicide reaction to begin.

11. The method of claim 1, wherein the first temperature is less than about 1,050 degrees C.

12. The method of claim 11, wherein the first temperature is maintained for a time of less than about 2 hours.

13. The method of claim 1, wherein the second temperature is greater than that required for a silicide reaction to be complete.

14. The method of claim 1, wherein the second temperature is greater than about 1,050 degrees C.

15. The method of claim 14, wherein the second temperature is maintained for a time of more than about 4 hours.

16. The method of claim 1, further comprising disposing an environmentally-resistant coating on a surface of the refractory metal-intermetallic composite.

17. The method of claim 1, further comprising disposing a thermal barrier coating on a surface of the refractory metal intermetallic composite.

18. The method of claim 1, further comprising using high-energy ball milling to achieve a coating of the first powder comprising the refractory metal on the second powder comprising the silicide precursor.

19. A method for forming a refractory metal-intermetallic composite article, the method comprising:

providing a first powder comprising a refractory metal suitable for forming a metal phase;

providing a second powder comprising a silicide precursor suitable for forming an intermetallic phase;

blending the first powder and the second powder to form a powder blend;

consolidating and mechanically deforming the powder blend at a first temperature; and reacting the powder blend at a second temperature to form the metal phase and the intermietallic phase of the refractory metal-intermetallic composite article, wherein the second temperature is higher than the first temperature;

wherein the first powder comprises at least one of niobium, titanium, and molybdenum; and the second powder comprises at least one of silicon, germanium, and boron wherein the refractory metal-intermetallic composite has a graded composition.

20. The method of claim 19, wherein the first powder comprises niobium, titanium, and hafnium.

21. The method of claim 19, wherein the second powder comprises silicon, chromium, and aluminum.

22. The method of claim 19, wherein the refractory metal-intermetallic composite article comprises titanium, hafnium, silicon, chromium, and niobium.

23. The method of claim 19, wherein the refractory metal-intermetallic composite article comprises between about 15 atomic percent and about 30 atomic percent titanium, between about 1 atomic percent and about 8 atomic percent hafnium, between about 5 atomic percent and about 25 atomic percent silicon, between about 1 atomic percent and about 14 atomic percent chromium, and a balance of niobium, based upon the total composition.

24. The method of claim 19, wherein the refractory metal-intermetallic composite article comprises between about 15 atomic percent and about 30 atomic percent titanium, between about 1 atomic percent and about 8 atomic percent hafnium, up to about 10 atomic percent tantalum, between about 5 atomic percent and about 25 atomic percent silicon, up to about 6 atomic percent germanium, up to about 12 atomic percent boron, between about 1 atomic percent and about 14 atomic percent chromium, up to about 4 atomic percent iron, up to about 4 atomic percent aluminum, up to about 5 atomic percent tin, up to about 3 atomic percent tungsten, up to about 3 atomic percent molybdenum, and a balance of Niobium, based upon the total composition.

25. The method of claim 19, wherein the refractory metal-intermetallic composite article comprises silicon, germanium, and boron, together comprising between about 5 atomic percent and about 25 atomic percent of the refractory metal-intermetallic composite, iron and chromium, together comprising between about 1 atomic percent and about 18 atomic percent of the refractory metal-intermetallic composite.

26. The method of claim 19, wherein consolidating the powder blend comprises consolidating the powder blend using a technique selected from the group consisting of cold isostatic pressing, hot isostatic pressing, hot pressing, explosive consolidation, magnetic pulse consolidation, ram pre-extrusion consolidation, hot forging, hot swaging, and hot extrusion.

27. The method of claim 19, wherein mechanically deforming the powder blend comprises mechanically deforming the powder blend using a technique selected from the group consisting of cold extrusion, hot extrusion, cold forging, hot forging, cold rolling, hot rolling, cold swaging, and hot swaging.

28. The method of claim 19, wherein the first temperature is less than that required for a silicide reaction to begin.

29. The method of claim 19, wherein the first temperature is less than about 1,050 degrees C.

30. The method of claim 29, wherein the first temperature is maintained for a time of less than about 2 hours.

31. The method of claim 19, wherein the second temperature is greater than that required for a silicide reaction to be complete.

32. The method of claim 19, wherein the second temperature is greater than about 1,050 degrees C.

33. The method of claim 32, wherein the second temperature is maintained for a time of more than about 4 hours.

34. The method of claim 19, further comprising disposing an environmentally-resistant coating on a surface of the refractory metal-intermetallic composite article.

35. The method of claim 19, further comprising disposing a thermal barrier coating on a surface of the refractory metal intermetallic composite article.

36. The method of claim 19, further comprising using high-energy ball milling to achieve a coating of the first powder comprising the refractory metal on the second powder comprising the silicide precursor.

* * * * *